United States Patent [19]

Safford

[11] 4,149,703

[45] Apr. 17, 1979

[54] APPARATUS FOR QUENCHING A HEATED METAL PLATE

[75] Inventor: Franklin C. Safford, Philadelphia, Pa.

[73] Assignee: Drever Company, Huntingdon Valley, Pa.

[21] Appl. No.: 873,892

[22] Filed: Jan. 31, 1978

[51] Int. Cl.[2] ..... C21D 1/64

[52] U.S. Cl. ..... 266/117; 134/199; 266/113

[58] Field of Search ..... 266/112–114, 266/117; 148/153; 134/199; 72/201

[56] References Cited

U.S. PATENT DOCUMENTS

| | | | |
|---|---|---|---|
| 3,420,083 | 1/1969 | Safford et al. | 72/201 |
| 3,423,254 | 1/1969 | Safford et al. | 266/117 |
| 3,546,911 | 12/1970 | Lenz | 266/117 |
| 3,604,696 | 9/1971 | Coleman et al. | 266/117 |
| 3,793,867 | 2/1974 | Safford | 72/201 |
| 3,885,581 | 5/1975 | Dahan et al. | 266/113 |
| 3,990,257 | 11/1976 | Taylor et al. | 266/114 |

FOREIGN PATENT DOCUMENTS

| | | | |
|---|---|---|---|
| 870556 | 6/1961 | United Kingdom | 266/113 |
| 415314 | 2/1971 | U.S.S.R. | 266/112 |

*Primary Examiner*—Roy Lake
*Assistant Examiner*—John McQuade
*Attorney, Agent, or Firm*—Buell, Blenko & Ziesenheim

[57] ABSTRACT

An apparatus for quenching a heated metal plate moving and restrained in a plane has upper and lower rolls which engage the top and bottom surfaces of the plate. Jets of quench fluid are located between the rolls and direct quench fluid onto the top and bottom surfaces of the plate in the direction of travel of the plate. A tank member is positioned underneath and surrounding the bottom rolls for maintaining the level of quenching fluid so that the plate conveyed on the lower rolls will have its bottom surface continuously swept with high velocity turbulent fluid.

1 Claim, 2 Drawing Figures

APPARATUS FOR QUENCHING A HEATED METAL PLATE

The invention relates to an apparatus for equalizing the severity of cooling rates of hot metal plates which are quench hardened while moving and restrained in a plane.

PROBLEM PRESENTED TO THE INVENTOR

Apparatus has been designed by me to quench harden a heated metal plate. This apparatus has an upper and lower roller bed to restrain and move the plate in a plane. An initial curtain of quench fluid impinges the surfaces of the plate as it moves through the quench apparatus. The initial impingement occurs near an entry zone of the apparatus where the plate enters. The apparatus is fully disclosed in my U.S. Pat. No. 3,420,083. After the initial impingement of quench fluid, additional quench fluid is directed onto the plate surfaces. This additional quench fluid is directed from jets located between the rollers located beyond the initial impingement at the entry zone. At the area of initial impingement, quench fluid impinging the top surface and bottom surface can be adjusted to produce a quench severity which is equal on the top and bottom surfaces of the plate.

However, after the initial quench there is a problem which makes it difficult to balance the quench severity so that plate is produced consistently flat. Gravity acting on the quench fluid delivered to the bottom plate surface pulls the fluid away from the bottom surface and the retention and accumulation of fluid on the top plate surface creates large differences in the cooling intensities between the top and bottom surfaces of the plate. This cooling rate differential creates stresses within the plate which cause it to warp as soon as it is released from the restraining forces of the upper and lower roller beds in the quench.

PRIOR ART

Attempts have been made to solve the problem by changing the quench fluid delivery conditions in order to create a balance of stresses which in some instances result in reasonably flat plate. Such techniques used included varying the pattern and velocity of the jets used to deliver the fluid to the two surfaces and to vary the speed at which plates of differing thicknesses were passed through the quench. Use of these techniques has not provided consistent production of flat quenched plate. The present invention, however, solves the problem by the creation of equal top and bottom quench severity and equal cooling rates between the top and bottom surfaces in the area following the initial impingement of quench fluid on the plate.

THE INVENTORS SOLUTION TO THE PROBLEM

I provide an apparatus for quenching a heated metal plate moving and restrained in a plane by upper and lower rolls which are spaced apart to engage top and bottom surfaces of the plate wherein the improvement comprises:

(a) means located between the upper rolls and between the lower rolls for directing quench fluid onto the surfaces of the plate at an angle with the plate of less than 90° and only in the direction of travel of the plate through the apparatus to create a continuous sweeping action of quench fluid along the plate in the direction of the plate travel;

(b) a tank member positioned under the lower rolls, the tank member having a pair of side walls with top edges in a plane approximately in a plane formed by top peripheries of the lower rolls; and (c) an adjustable gate member at an end of the tank member at an end of the apparatus where the plate passes beyond the tank member, the gate member adjusts the level of quench fluid in the tank member and causes the fluid to raise to a level whereby the quench liquid is in intimate turbulent continuous sweeping contact with the bottom surface of the plate and the quench fluid is continuously swept along the plate with high velocity in the direction of travel of the plate.

A DESCRIPTION OF THE STRUCTURE OF THE APPARATUS

Figure 1:
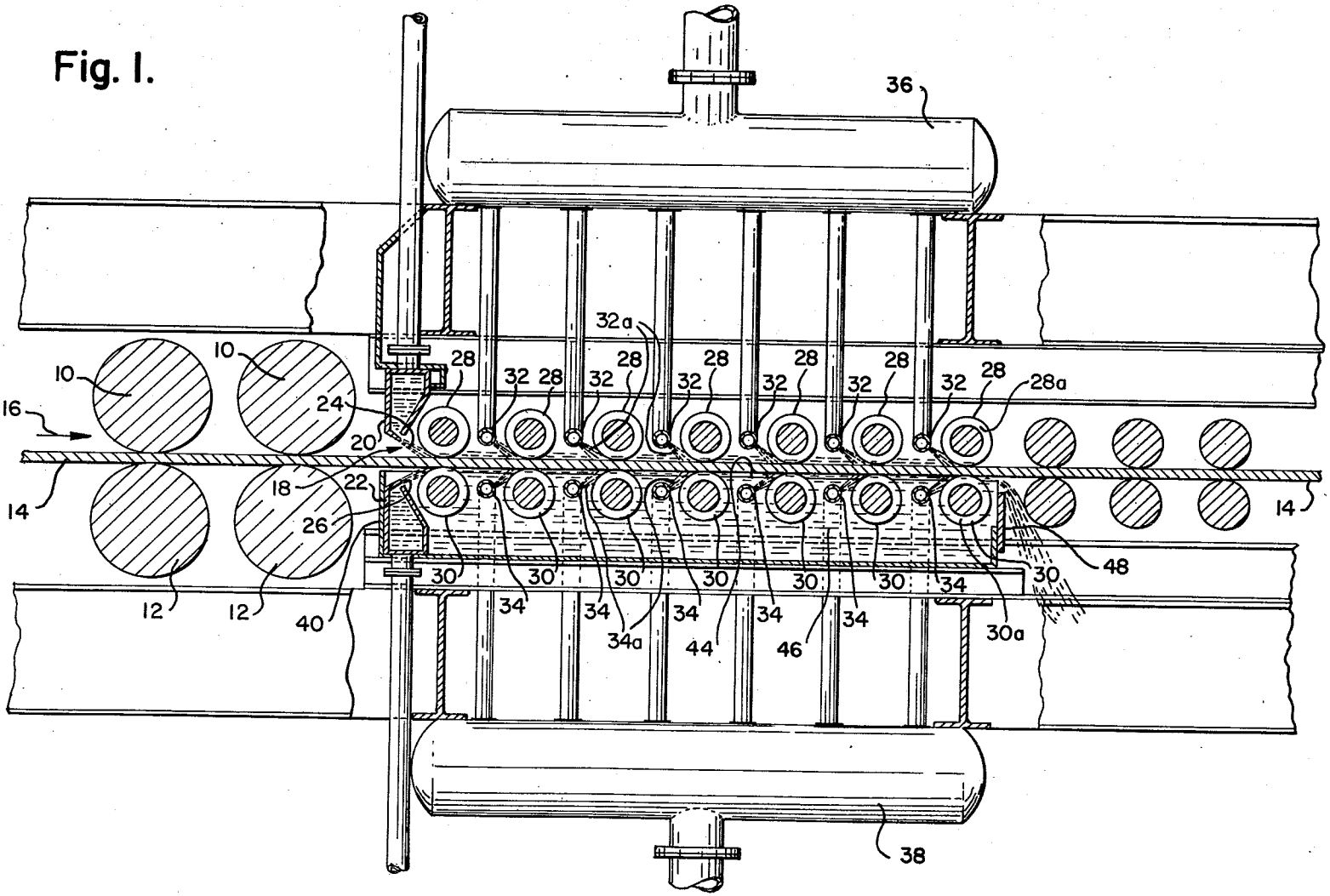
FIG. 1 is a side sectional elevational view of the quench apparatus with one side wall of the tank cut away. The ends of the tank are shown with the adjustable gate at the exit end of the apparatus.
Figure 2:
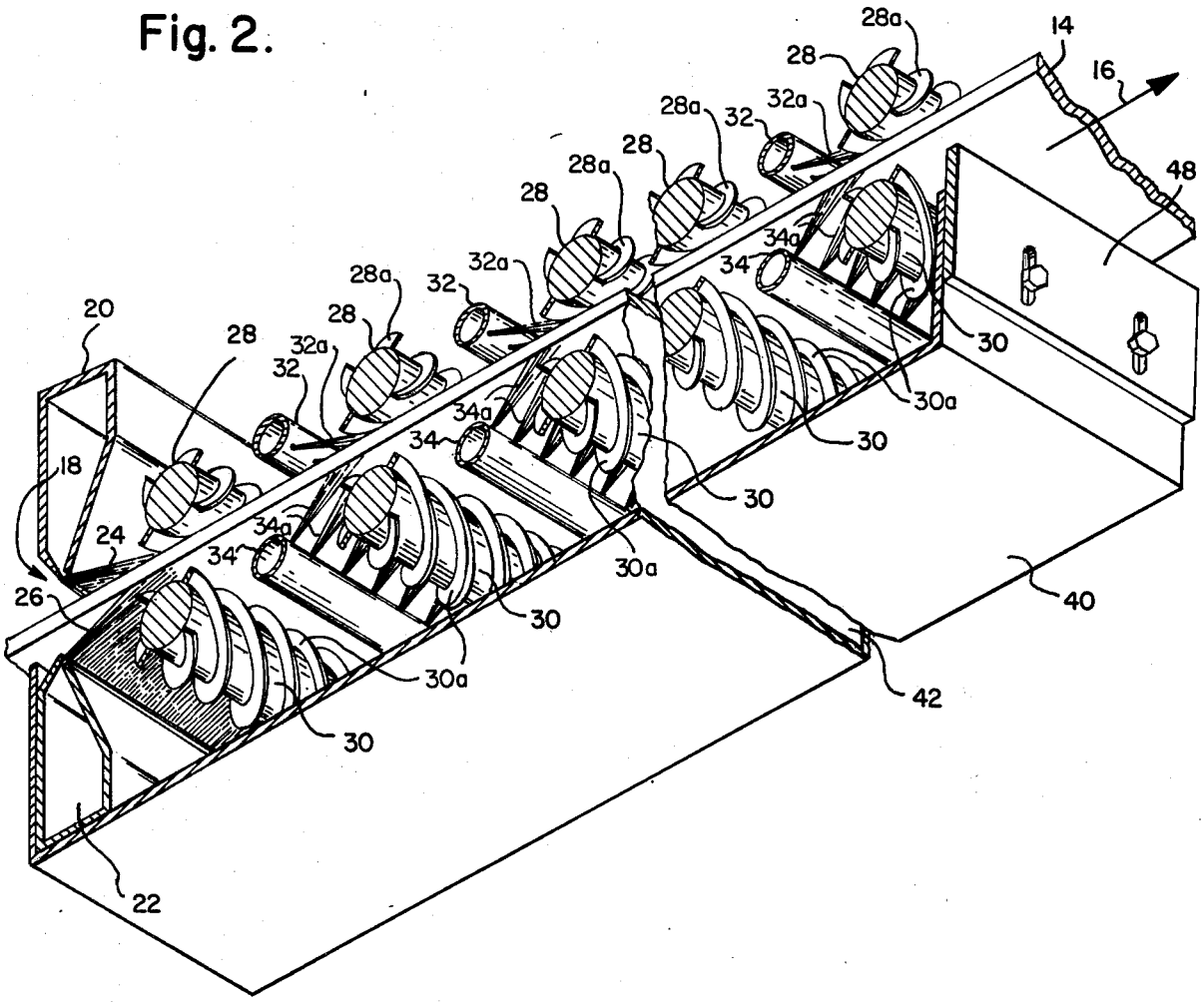
FIG. 2 is an isometric cut-away-sectional view of the apparatus shown in FIG. 1 showing one side of the tank cut away.

The apparatus shown in FIGS. 1 and 2 is of the same type shown in my earlier issued U.S. Pat. Nos. 3,423,254; 3,420,083; and 3,793,867. The improvement comprises the use of a tank with an adjustable gate positioned underneath the lower roller bed to keep the bottom of the plate in contact with a turbulent bath of quench fluid and quench jets located between the upper rolls and between the bottom rolls for directing quench fluid onto the surfaces of the plate at an angle with the plate of less than 90° and only in the direction of travel of the plate through the apparatus to create a continuous sweeping action of quench fluid along the plate in the direction of the plate travel. The level of a quiescent bath, normally within less than one inch of the plate, raises to the bottom surface of the plate when the means supplying quench fluid is turned 'on' and impinges the bottom of the plate. The level of quench fluid in the tank raises and turbulently contacts the bottom of the plate. The bottom surface of the plate is continuously swept with high velocity turbulent fluid in the direction of the travel of the plate.

The quench system comprises a plurality of upper and lower entry cylindrical rolls 10 and 12 which restrain the plate 14 in a plane and moves the plate in the direction of the arrow 16 which is at the entry end 18 of the quench apparatus. Quench headers 20 and 22 produce high velocity high intensity quench curtains 24 and 26 which impinge the plate 14 on the top and bottom surfaces. Positioned beyond quench headers 20 and 22 are upper rolls 28 and lower rolls 30 each having spiraled ribs 28(a) and and 30(a) respectively (shown also in U.S. Pat. No. 3,793,867). Located between the rolls 28 and 30 are quench jets 32 and 34 which each produce quench fluid 32(a) and 34(a) that impinges the surfaces of the plate at an angle with the plate of less than 90° and only in the direction of travel 16 of the plate thereby creating a continuous sweeping action of quench fluid along the plate. Jets 32 and 34 are supplied by common headers 36 and 38. A liquid retaining tank member 40 having side walls 42 is shown in FIG. 2. The side walls 42 have top edges 44 (FIG. 1) in a plane approximately in a plane formed by the top peripheries of the lower rolls 30. At the end of the tank 40 is an adjustable gate 48 which adjusts the level of quench fluid 46 in the tank member 40. The lower rolls have seals (not shown) around their shafts at the tank walls 42 to restrain quench liquid leakage.

THE OPERATION

An upper frame which supports rolls 10 and 28 is positioned until the upper rolls 10 are positioned to restrain the metal plate 14 as it enters the apparatus after leaving a furnace (not shown). The plate 14 enters the apparatus at 18 and the moves in the direction of travel shown by arrow 16. The plate 14 then passes and is restrained between rolls 10, 12, 28 and 30. High intensity quench fluid curtains 24 and 26 from headers 20 and 22 impinge on the top and bottom surfaces of the plate 14 at an angle between 10° and 40° which prevents the quench fluid from reaching a part of the plate not advanced to the initial point of impingement. Intermediate intensity quench liquid streams 32(*a*) and 34(*a*) from quench jets 32 and 34 continue the quench of the plate 14 and impinge the plate at an angle and in the direction of plate travel 16 to create a continuous sweeping action of quench fluid along the plate. Large quantities of intermediate intensity quench fluid are discharged into the water retained in tank 40 to create a sweeping continuously violent turbulent contact of quench liquid with the bottom surface of plate 14.

The adjustable gate 48 is adjusted to maintain a quench liquid level in tank 40 by allowing water to leave the tank at a rate equal to that at which it enters and to off set losses over the tank walls 42. The gate adjustment regulates the level of the liquid to raise it to an elevation whereby the quench liquid is in sweeping turbulent contact with the bottom surface of the plate. Thus, the cooling rates of the bottom and top surfaces of the plate 14 are equalized.

It is to be understood that such arrangement is also effective to quench high strength low alloy steels in a platen pressure quench apparatus.

I claim:

1. An apparatus for quenching a heated metal plate comprising upper and lower rolls which are spaced apart to engage top and bottom surfaces of the plate to move and restrain the plate in a plane wherein the improvement comprises:

(a) means located between the upper rolls and between the lower rolls for directing quench fluid onto the surfaces of the plate at an angle with the plate of less than 90° and only in the direction of travel of the plate through the apparatus to create a continuous sweeping action of quench fluid along the plate in the direction of the plate travel;

(b) a tank member positioned under the lower rolls, the tank member having a pair of side walls with top edges in a plane approximately in a plane formed by top peripheries of the lower rolls; and (c) an adjustable gate member at an end of the tank member at an end of the apparatus where the plate passes beyond the tank member, the gate member adjusts the level of quench fluid in the tank member and causes the fluid to raise to a level whereby the quench liquid is in intimate turbulent continuous sweeping contact with the bottom surface of the plate and the quench fluid is continuously swept along the plate with high velocity in the direction of travel of the plate.

* * * * *